US005332100A

United States Patent [19]

Jameson

[11] Patent Number: 5,332,100

[45] Date of Patent: Jul. 26, 1994

[54] COLUMN FLOTATION METHOD

[75] Inventor: Graeme J. Jameson, New Lambton, Australia

[73] Assignee: The University of New Castle Research Associates Limited of University of New Castle, Australia

[21] Appl. No.: 967,197

[22] Filed: Oct. 27, 1992

Related U.S. Application Data

[63] Continuation-in-part of Ser. No. 839,253, Feb. 20, 1992, abandoned, which is a continuation of Ser. No. 704,700, May 17, 1991, abandoned, which is a continuation of Ser. No. 547,626, Jul. 2, 1990, abandoned, which is a continuation of Ser. No. 100,956, Sep. 25, 1987, Pat. No. 4,938,865.

[30] Foreign Application Priority Data

Sep. 25, 1986 [AU] Australia ..... PH08216

[51] Int. Cl.[5] ..... B03D 1/02; B03D 1/24

[52] U.S. Cl. ..... 209/164; 209/168; 209/170; 210/703; 261/36.1; 261/DIG. 75; 261/DIG. 26

[58] Field of Search ..... 209/164, 168, 169, 170; 210/703; 261/DIG. 75, DIG. 26, 121, 36.1

[56] References Cited

U.S. PATENT DOCUMENTS

| | | | |
|---|---|---|---|
| 1,124,855 | 1/1915 | Callow | 209/170 |
| 1,333,712 | 3/1920 | Groch | 209/170 |
| 1,470,350 | 10/1923 | Court | 209/170 |
| 2,758,714 | 8/1956 | Hollingsworth | 209/170 |
| 3,255,882 | 6/1966 | McCarty | 209/170 |
| 4,220,612 | 9/1980 | Degner | 209/170 |
| 4,226,706 | 10/1980 | Degner | 209/170 |
| 4,431,531 | 2/1984 | Hollingsworth | 209/170 |
| 4,477,341 | 10/1984 | Schweiss | 209/170 |
| 4,534,862 | 8/1985 | Zlokarnik | 209/170 |
| 4,726,897 | 2/1988 | Schweiss | 209/170 |
| 4,938,865 | 7/1990 | Jameson | 209/170 |

FOREIGN PATENT DOCUMENTS

| | | | |
|---|---|---|---|
| 663614 | 5/1963 | Canada | 209/170 |
| 477162 | 3/1992 | European Pat. Off. . | |
| 2338071 | 1/1976 | France . | |
| 513723 | 7/1976 | U.S.S.R. | 209/164 |
| 662150 | 5/1979 | U.S.S.R. | 209/164 |
| 663433 | 5/1979 | U.S.S.R. | 209/164 |
| 740284 | 6/1980 | U.S.S.R. | 209/164 |
| 1549523 | 8/1979 | United Kingdom . | |
| 2129714 | 5/1984 | United Kingdom . | |
| 92/03218 | 3/1992 | World Int. Prop. O. . | |

*Primary Examiner*—Thomas M. Lithgow
*Attorney, Agent, or Firm*—Ostrolenk, Faber, Gerb & Soffen

[57] ABSTRACT

A method for the beneficiation of mineral ores by the flotation method whereby a slurry is introduced under pressure into the top of a first column through a downwardly facing nozzle, and air is entrained into the slurry forming a downwardly moving foam bed in the first column. The foam bed passes from the bottom of the first column into a second column where the froth and liquid separate, the froth carrying the values floating upwardly and over a weir and the liquid being drained with the gangue. The liquid/froth interface level in the second column is kept above the bottom of the first column, and the air flow rate into the top of the first column is controlled to keep the first column substantially full of foam.

14 Claims, 2 Drawing Sheets

COLUMN FLOTATION METHOD

CROSS-REFERENCE TO RELATED APPLICATION

This is a continuation-in-part of U.S. Ser. No. 07/839,253 filed Feb. 20, 1992, abandoned, which is a continuation of U.S. Ser. No. 07/704,700 filed May 17, 1991, abandoned, which is a continuation of U.S. Ser. No. 07/547,626 filed Jul. 2, 1990, abandoned, which is a continuation of U.S. Ser. No. 07/100,956 filed Sep. 25, 1987, now U.S. Pat. No. 4,938,865.

BACKGROUND OF THE INVENTION

This invention relates to an improved flotation method and more particularly to column flotation for the beneficiation of mineral ores and the like.

Flotation is a known process for the separation of particulate materials from slurries or suspensions in a liquid, usually water. The particles which it is desired to remove from the suspension are treated with reagents to render them hydrophobic or water repellent, and a gas, usually air, is admitted to the suspension in the form of small bubbles. The hydrophobic particles come into contact with the bubbles and adhere to them, rising with them to the surface of the liquid to form a froth. The froth containing the floated particles is then removed as the concentrate or product, while any hydrophilic particles are left behind in the liquid phase and pass out as the tailings. The flotation process can be applied to suspensions of minerals in water, and also to the removal of oil droplets or emulsified oil particles, as well as to fibrous or vegetable matter such as paper fibres and bacterial cells and the like.

In most applications it is necessary to add reagents known as collectors which selectively render one or more of the species of suspended particles hydrophobic, thereby assisting in the process of collision and collection by the air bubbles. It is also usual to add frothing agents to assist in the formation of a stable froth on the surface of the liquid. The process of admitting these various reagents to the system is known as conditioning.

In conventional known cells, the contact between the air and the conditioned slurry is effected in a rectangular cell or tank having substantially vertical walls, the contents of the cell being stirred by a mechanical agitator which usually serves the additional purpose of breaking up the supply of air into small bubbles. In another known process described as column flotation, the conditioned suspension is introduced toward the top of a tall vertical column, and air bubbles are formed in the bottom of the column by blowing pressurised air through a diffuser. A layer of froth bearing the floatable particles forms above the liquid and overflows from the top of the column. The liquid containing the non-floating particles discharges from the bottom of the column. The position of the froth-liquid interface is maintained at a desired level by controlling for example the flow of liquid from the bottom of the column.

In some embodiments, wash water is introduced near the top of the froth layer to create a downflow of liquid which tends to reduce the entrainment of undesired gangue particles in the froth overflow.

In such known flotation columns, the liquid flows downward while the bubbles rise vertically upward. Since the rise velocity of the bubbles is related strongly to their size, the bubbles must be above a certain critical diameter in order that they may rise through the liquid and into the froth layer.

This method of operation using counter-current flow of liquid and bubbles possesses several operating difficulties or deficiencies when implemented. Any bubbles smaller than the critical size will be swept down the column and out in the tailings stream, carrying with them any floatable particles which may be adhering to them. Furthermore the necessity to operate with relatively large bubbles, typically in the range 1 to 3 mm in diameter, places a limit on the area of gas-liquid interface that can be created in the column. Since the quantity of particles that can be recovered from the liquid varies directly as the interfacial area of the bubbles, it would obviously be desirable to disperse the given quantity of air provided into the finest practicable size in order to give a large surface area and hence maximize the recovery of the particles.

Another disadvantage with known columns is that the proportion of bubbles in the total volume of the liquid phase in the column is relatively low, being typically in the range 10 to 20 percent. Thus the distance between bubbles is relatively large and the probability of contact between particles and bubbles is relatively lower than if the bubbles were very closely packed. A low probability of contact leads to low recovery rates of floatable particles, and to the necessity for very tall columns or a multiplicity of columns to achieve a desired yield.

A further disadvantage is related to the necessity in floatation columns to introduce the air through a diffuser made of porous material containing very fine holes. Such diffusers tend to block or become plugged, not only with fine particles but also from deposits which form by precipitation, especially when the liquid has a high concentration of dissolved solids.

It is the purpose of the present invention to provide a simple, efficient and economic means of conducting the flotation process which overcomes the difficulties inherent in known columns, by creating a stable dispersion of bubbles in the liquid, which bubbles may be as fine as desired without detriment to the process, and which may be present in very high void fractions thereby creating an environment highly favourable to the capture of the floatable particles.

SUMMARY OF THE INVENTION

The invention provides a method of separating particulate materials from slurries or suspensions in a liquid, said method comprising the steps of:

introducing the liquid in a downwardly facing jet into the upper part of a first column having a lower end communicating with a second column or chamber alongside at least the lower part of the first column, the upper part of the first column having a controlled gas inlet;

plunging the jet into a foam bed in the first column causing gas from the first column to be entrained by the jet into the foam bed and generate more foam;

allowing the foam level to rise in the first column until the pressure at the lower end of the first column is greater than the pressure in the second column adjacent the lower end of the first column causing the foam bed to move downwardly in the first column and issue from the lower end into the second column or chamber;

controlling the flow of gas through the controlled gas inlet to maintain the foam level in the first column such that the pressure at the lower end of the first column is greater than the pressure in the second column adjacent the lower end of the first column;

allowing froth from the foam to separate from liquid in the second column forming a liquid/froth interface;

removing the froth with entrained particulate materials from the upper part of the second column; and removing remaining liquid from the lower part of the second column or chamber.

The separation or flotation process is carried out in two steps. A suspension of finely divided material which has been suitably conditioned with collector and frother reagents, is introduced to the top of a column with a suitable quantity of air. The liquid is preferably injected in the form of one or more jets which point vertically downward and entrain the air, creating a bed of dense foam. The foam bed then flows downward through the column, issuing at its base into an adjoining vertical column where it is permitted to separate into two layers—a froth layer containing the floatable particles which rises upward to discharge over a suitably-placed weir; and a liquid layer containing the unfloated gangue particles which then pass through the liquid drain to tailings.

The principle of the invention is therefore to create in the first or contacting column a co-current downward flow of air and liquid containing the suspended particles, in the form of a dense foam of void fraction typically 0.5 approximately, thereby providing an environment highly favourable to the capture of floatable particles at a gas-liquid interface. The second or froth column acts as a relatively quiescent froth reservoir in which excess liquid is permitted to drain downward and out of the chamber in a tailings stream while the product in the form of a relatively dry froth containing the floatable particles, flows out from the top.

The principle differs from known flotation devices in that the contacting between the floatable particles and the gas takes place entirely in the foam bed, and it is not necessary for the successful operation of the device for the air or the dense foam to bubble through a liquid layer. At no stage is air bubbled into a liquid as in conventional agitated flotation cells or flotation columns. The strong mixing action of the liquid jets creates a dense foam instantaneously, which is stabilised by the particles and reagents present and travels in a substantially plug-flow downward through the collection column.

Another unique feature of the invention concerns the relation between the high void fraction and the downward flow in the first column. Under the action of gravity, the bubbles will tend to rise upward in the column. However at the same time the liquid is moving vertically downward. Thus, provided the downward velocity of the liquid exceeds the rise velocity of the bubble swarm, a stable operation is possible with a nett downward motion of the total foam bed. Because of the crowding effect of the bubbles acting together, the effective rise velocity of the bubble swarm is much less than that of an individual bubble from the swarm rising alone in the liquid. Accordingly it is possible to operate the first column with a relatively low downward liquid superficial velocity, to create a dense liquid foam containing up to 60 percent by volume of gas bubbles whose size depends on the operating conditions but which are typically less than 0.5 mm in diameter.

In the method of operation according to the invention, the downward flow in the first column arises mainly through the action of gravity. Dynamic pressures can arise through changes in the momentum flowrate between the point of entry of the jet or jets in the top of the first column, and the bottom end of the column where the dense foam issues into the second column. At the entry to the dense foam layer immediately below the jet entry point, the total momentum flow comprises that associated with the high-speed liquid jet and that in the air stream, while at the column exit, the momentum flowrate is that of the dense foam. It is a feature of the invention that the pressure arising from the change in the overall momentum flowrate between the top and the bottom of the first column is small compared with the change in the hydrostatic head within the first column. This feature is brought about by the choice of the relative diameters of the jet and the column.

Because of the high void fraction and the small diameter of the bubbles, the liquid films between the bubbles are very thin and are indeed of the same order of magnitude in thickness as the size of typical floatable particles. Thus the particles do not have to move far before coming into contact with an interface and hence forming an attachment with a bubble.

The environment in the first or collection column is particularly favourable for the efficient recovery of floatable particles, not only because of the high void fractions but also because of the high gas-to-liquid flow rate ratios at which the column can be operated. Thus volumetric ratios of gas to liquid of as high as two to one can conveniently be obtained.

In the second or froth column, a nett counterflow of gas and liquid exists. The liquid drains under gravity leaving a relatively dry froth to discharge at the top of the column carrying the floatable particles. It is convenient to maintain a pool or reservoir of the drained liquid in the bottom of the froth column, and a relatively sharp interface develops between the froth and the drained liquid. The height of this interface can be controlled to a desired level by suitable means.

DESCRIPTION OF THE DRAWINGS

Notwithstanding any other forms that may fall within its scope, one preferred form of the invention will now be described by way of example only with reference to the accompanying drawings in which.

DESCRIPTION OF THE PREFERRED EMBODIMENT

Figure 1:
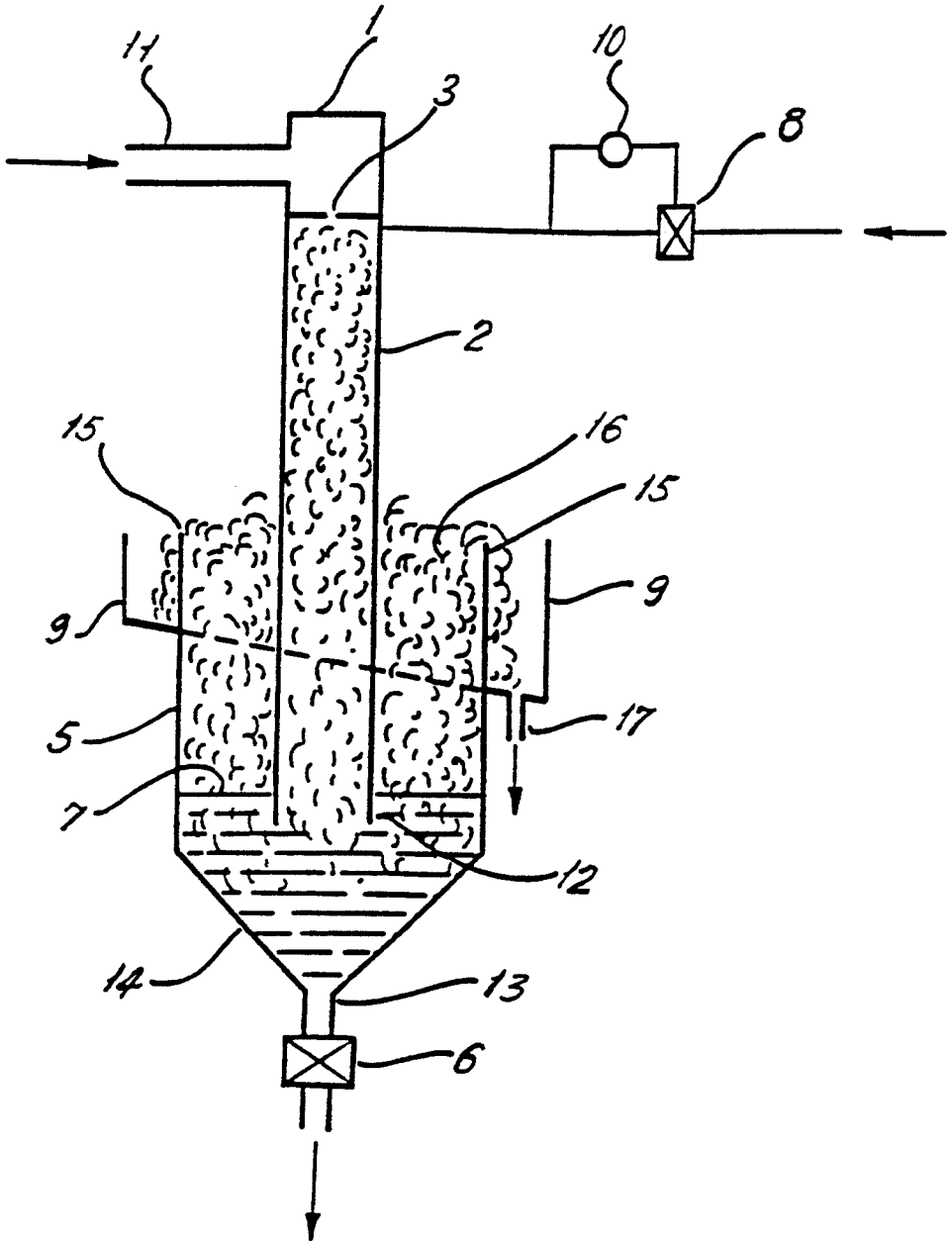
FIG. 1 is a diagrammatic cross sectional elevation of one form of flotation cell for use with the method according to the invention.

Suitably conditioned feed liquid is introduced through an inlet conduit (11) to a chamber (1) in the top of a first or inner column or downcomer (2), from which it passes through an orifice (3), so that it issues into the top of the first column in the form of a downwardly facing high-speed liquid jet. The jet points vertically downward and falls through the downcomer (2) which is also substantially vertical.

The first column (2) has an open lower end (12) communicating with the lower region of a second vessel or column (5). In the configuration shown in the drawing, the first and second columns are circular in horizontal section and concentric, but it will be appreciated that the columns could be side by side and have other cross sectional areas. The vessel (5) drains to a lower point (13) (e.g. by way of conically tapered lower wall 14) and is provided with a gangue outlet control valve (6). The upper lip (15) of the vessel (5) forms an overflow weir for froth (16) which collects in a launder (9) and is drained away through outlet (17).

In operation, the downcomer (2) becomes filled with a dense froth which travels downward to discharge into the outer vessel (5). The level of liquid in the outer vessel or container is maintained by the valve (6) or other means, at a level (7) which is above the level of the lower end of the downcomer, so forming a hydraulic seal for the downcomer. The hydraulic seal is important, as without it, the froth will not rise substantially in the downcomer.

Figure 2:
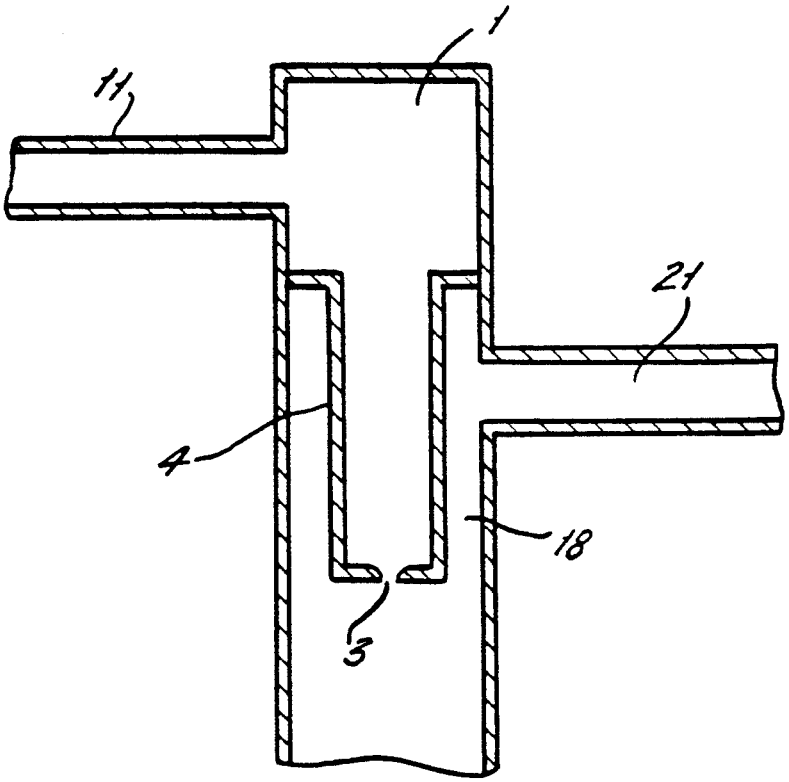
FIG. 2 is an enlarged view showing detail of the liquid branch pipe used with the orifice assembly of FIG. 1.

Air is entrained by the liquid jet as it plunges into the dense foam in the first column (2) through the boundary layer which forms on the surface of the jet. As soon as the jet leaves the orifice (3) and passes into the air-space at the top of the first column, a boundary layer or thin film of air attaches to the surface of the liquid jet, and is carried with it as it plunges into the bed of dense foam. It has been found by experiment that the size of the bubbles produced by the plunging jet is influenced by the disturbances on the surface of the jet arising from turbulence in the flow upstream of the orifice (3), or through roughnesses on the surface of the orifice itself, and that the best results are found if the surface of the jet is relatively smooth and undisturbed. Accordingly it has been found advantageous to incorporate a branch pipe (4) between the entrance chamber (1) and the orifice (3) as shown in FIG. 2 to assist in calming the flow. The diameter of the branch pipe (4) should be at least twice that of the orifice (3), and the length should be in the range 2 to 20 times the diameter. The branch pipe (4) has the additional advantage of separating the dense foam contents in the first column (2) from the air entry conduit (21).

Figure 3A:
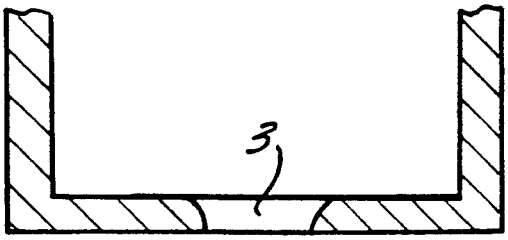
FIG. 3*a* is an enlarged view of one embodiment of the orifice.
Figure 3B:
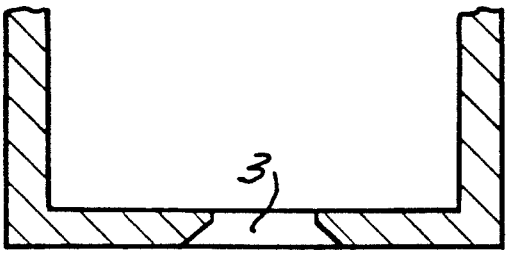
FIG. 3*b* is an enlarged view of an alternative embodiment of the orifice.

The orifice (3) should be smooth and symmetrical in shape in order to create minimum disturbance to the flow. FIG. 3*a* shows one convenient form, a so-called quarterplate orifice, in which the vertical section of the orifice is in the form of a quarter circle of radius equal to the thickness of the plate (19) from which it is constructed. FIG. 3*b* shows an alternative orifice which has the form of a standard sharp-edged orifice plate. Similar orifices can also be used in the embodiment shown in FIG. 1.

Air is introduced to the top of the column (2), through a valve (8) operated by a controller (10) and mixes with the incoming feed liquid, so that the downcomer becomes filled with a dense foam of finely-dispersed air bubbles. Thus a very favourable environment is created for contact between the air and the liquid, enabling the floatable particles in the feed to become attached to the air bubbles.

When the dense foam leaves the bottom of the downcomer (2), the air bubbles rise up the annular gap between the two columns in the form of a froth, which carries the floatable particles, and the froth (16) then discharges over the weir (15) into the launder (9). The pulp bearing the gangue or unfloated particles discharges from the bottom of the vessel (5) under the control of the valve (6).

When the operation of the device is first commenced, there is no liquid in the system. The valve (8) is closed so that no air is admitted to the first column. The flow of feed liquid to the first column is commenced. The valve (6) is closed, so that the liquid level gradually rises in the vessel (5), until it reaches the base of the first column (2), and can be stabilised by a suitable control mechanism (not shown) at a general level (7) just above the bottom of the column (2). At this stage, the jet is plunging directly into the free surface of the liquid near the bottom of the first column, and because of the frothers and other conditioning agents in the feed, a froth quickly generates. Air is entrained into the froth by the action of the jet, so the upper surface of the froth quickly rises to fill the first column (2).

Because of the net downward motion of the liquid, there is a tendency for small bubbles to be carried out of the bottom of the column (2), and if no air is admitted, after a period of time most of the air originally in the column will have been carried down and out. Once the froth level in the first column has reached substantially the position of the nozzle (3) however, it is possible to open the valve (8) and admit air. Provided the rate of inflow of air does not exceed the rate at which air is being entrained into the froth by the jet, the froth level will remain at or near the point of entry of the liquid jet. Under these conditions, the whole column (2) remains filled with a dense downwardly moving froth bed.

Although the apparatus has been described in relation to a liquid distribution device containing only one orifice or nozzle (3), the invention applies also where there is a multiplicity of orifices, nozzles or slits, of fixed or variable area, through which the liquid may flow. In fact, any method of dispersing the air feed into small bubbles may be used, such as a diffuser consisting of a porous plug through which air may be driven under pressure, or a venturi device in which the liquid is forced through a contracting-expanding nozzle and air is admitted in the region of lowest pressure. The liquid jet has the advantage that if large bubbles should form by coalescence of smaller bubbles in the body of the foam bed in the first column (2) and subsequently raise to the top of the column, they can be re-entrained in the jet and become dispersed once more in the foam.

When the jet issues from the orifice, and plunges into the dense foam bed, it tends to spread within the foam, and if the first column is sufficiently long, the outer edges of the spreading jet flow will reach the confines of the column walls. It is highly desirable that the jet should spread and reach the inner wall of the first column, as in doing so it transfers its momentum across the whole cross-section of the first column to produce a homogeneous two-phase mixture which travels with uniform velocity down the column. In a preferred configuration, the jet velocity is of the order of 15 meters/sec whereas the velocity of the two-phase mixture is of the order 0.2 to 0.5 meters/sec. it has been observed that if the first column is too short, the extremities of the spreading jet do not reach the inner wall of the first column, and the jet extends past the lower open end (12) of the column while still travelling with high velocity. As a consequence, the performance of the column is much reduced in that it becomes very turbulent and unstable, the average bubble size is too large for efficient flotation and very large bubbles of air are swept from the open end (12) of the first column. It has been found by experiment that in order to allow the jet to spread to the wall of the first column, the length from the orifice (3) to the open end (12) of the first column should be at least four and preferably greater than eight times the diameter of the first column.

An important consideration in the method of operation described here, is the pressure inside the first column at the level of entry of the feed through the nozzle (3). For the dense foam to flow out of the first column under the influence of gravity, the sum of the pressure inside the first column at the level of entry of the feed through the nozzle (3) and the hydrostatic head of the dense foam which occupies the space in the first column above the lower end (12), must be sufficient to overcome the pressure in the liquid in the second column adjacent to the lower end (12) of the first column, which is comprised of the pressure acting on the top of the froth, together with the hydrostatic pressure due to the froth and the liquid layers in the second column. The magnitudes of the hydrostatic pressure changes will clearly depend on the dimensions of the first column and the depth of submergence of the open end (12) of the first column beneath the level of the liquid in the second column.

Without loss of generality, it is useful to consider several cases in which the froth in the second column is open to the atmosphere, as in most practical situations. In practical operations, it has been found that the void fraction (or fraction of two-phase fluid which is occupied by gas) in the dense foam in the first column is typically in the range 0.3 to 0.6, with 0.5 as a representative operating value. In the second column, where the froth is allowed to drain and become relatively dry and open in structure, the void fraction is typically in the range 0.8 to 0.95, and a void fraction of 0.9 can be taken as representative. From these figures it can be calculated that the density of the dense foam is typically half the density of the liquid, while the density of the froth is typically one-tenth of the density of the liquid and can be neglected.

It is useful to distinguish three cases: Case 1, in which the top of the first column is positioned so that the liquid jet issues into the first column at the same horizontal level as the froth-liquid interface in the second column, Case 2, where the hydrostatic head due to the foam bed in the first column is just sufficient to balance the head of liquid in the second column; and Case 3, where the level at which the jet issues in the first column is sufficiently higher than the froth-liquid interface, to allow a negative gauge pressure to be created adjacent to the jet.

Case 1. Here the heights of the foam layer in the first column and the liquid layer in the second column are approximately the same, but the density of the one is only about half the density of the other. Accordingly, the foam bed will not flow downwards unless the air pressure supplied to the top of the first column is sufficient to overcome the difference in hydrostatic heads, requiring air at a positive gauge pressure relative to the atmosphere. The supply of air at elevated pressure would require a compressor or blower and it would be preferable to obviate such mechanical equipment if the dimensions of the first column were chosen so as to enable the dense foam to flow by gravity alone, as in Cases 2 and 3.

Case 2. Here the level at which the jet issues in the first column is much higher than the froth-liquid interface, and it is possible to build up a height of dense foam, so that the hydrostatic head of the foam within the first column is sufficient to overcome the head of the liquid in the second column. Since the density of the one is approximately twice the density of the other, the pressure inside the first column at the level of the issuing jet will be the same as the pressure acting on the surface of the liquid, when the height of the moving dense foam bed is approximately twice the depth of immersion of the open end (12) of the first column beneath the froth-liquid interface.

Case 3. Here the height of the point of issue of the jet is greater than twice the depth of immersion of the open end (12) of the first column beneath the froth-liquid interface. In such circumstances, if the height of the dense foam bed in the first column is further increased above Case 2, the hydrostatic head arising from this foam bed will exceed the hydrostatic pressure in the liquid surrounding the open end (12) of the first column, and the foam bed level will not rise unless the pressure in the air at the jet issuing point (3) is reduced below the ambient or atmospheric pressure. This circumstance can readily be achieved in practice by restricting the flow of air by using the air control valve (8).

There are several important practical advantages in operating the flotation cell as in Case 3. Since the pressure in the air space at the head of the first column is to be maintained below the atmospheric pressure, air can be drawn from the atmosphere without the need for a compressor or blower. Also, the increase in height of the foam bed in such a case is advantageous in that the residence time of the dense foam in the first column is increased, leading to an increase in the contact time between bubbles and particles and hence to higher recovery of particles.

In the preferred apparatus and method of operating the invention, the height of the dense foam bed in the first column should be at least twice the depth of immersion of the open end of the first column below the froth-liquid interface in the second column.

The following preferred ratios and physical parameters have been established by experiment for the embodiments shown in FIGS. 1 and 2.

- Diameter of first column to diameter of orifice between 5:1 and 12:1.
- Length of first colum to diameter of first column 8:1 or greater.
- Diameter of second column to diameter of first column between 2:1 and 10:1.
- Velocity of jet through orifice 8 meters/sec minimum.

The fact that the pressure in the top of the first column (2) is below the external pressure when the froth column is properly established, can be used to control the operation. Thus it is convenient to link a pressure-actuated controller (10) to the air control valve (8) in such a way that if the pressure inside the top of the first column (2) drops below a predetermined value, the valve (8) is caused to close partially or completely, resulting in the re-establishment of the full bed of dense foam.

It is important to note that the air is entrained into the dense foam bed itself, not the liquid in the vessel (5) as is the normal practice in known types of flotation apparatus.

Although the description above refers to air being introduced through valve (8), it will be appreciated that other gases could be used for the flotation method. An example of the operation of one particular apparatus constructed according to the invention will now be described.

A column was constructed according to the principles shown in the attached drawing. The active parts of each of the first and second columns were right cylinders and the first column was mounted inside the second column, which had a conical bottom. The relevant dimensions are as follows:

| | |
|---|---|
| Diameter of first column | 100 mm |
| Diameter of second column | 500 mm |
| Height of first column | 1200 mm |
| Height of second column (cylindrical section) | 1100 mm |
| Level of botto of first column below froth overflow weir | 700 mm |
| Liquid level above bottom of first column | 200 mm |
| Feed rate | 90 kg/min |
| Feed density | 1240 kg/cubic meter |
| Air rate | 90 liters/min |
| Number of jets | 3 |
| Jet diameter | 5.5 mm |
| Pressure in air space adjacent jets in first column | −2800 Pa gauge |

A zinc ore was floated using sodium ethyl xanthate as collector and methyl isobutyl carbinol as frother. The feed grate was 30.0% Zn. The recovery was 56.1% and the concentrate grade was 42.1% Zn.

What I claim is:

1. A method of separating particulate material from slurries or suspensions in a liquid, said method comprising the steps of:

introducing the liquid containing the particulate material in a downwardly facing jet into an upper part of a first column having a lower end opening into a second column or chamber at a point between upper and lower ends of the second column or chamber, the upper part of the first column having a controlled gas inlet;

plunging the jet into a foam bed in the first column causing gas from the first column to be entrained by the jet into the foam bed and generate more foam;

allowing the foam level to rise in the first column until the pressure at the lower end of the first column is greater than the pressure in the second column adjacent the lower end of the first column causing the foam bed to move downwardly in the first column and issue from the lower end into the second column or chamber;

controlling the flow of gas through the controlled gas inlet to maintain the foam level in the first column such that the pressure at the lower end of the first column is greater than the pressure in the second column adjacent the lower end of the first column;

allowing froth from the foam to separate from liquid in the second column forming a liquid/froth interface;

removing the froth with entrained particulate materials from the upper part of the second column; and removing remaining liquid from the lower part of the second column or chamber.

2. A method as claimed in claim 1 wherein the flow of gas through the controlled gas inlet is controlled to maintain the foam level in the first column such that the foam bed fills a major portion of the first column.

3. A method as claimed in claim 2 wherein the liquid containing the particulate material is introduced into the upper part of the first column through a nozzle and wherein the gas flow rate is controlled to maintain the foam level in the first column approximately adjacent the level of the nozzle.

4. A method as claimed in claim 1 wherein the gas comprises air admitted from the atmosphere and wherein the gas inlet is controlled to maintain air pressure in the upper part of the first column at below atmospheric pressure.

5. A method as claimed in claim 4 wherein the liquid containing the particulate material is introduced into the upper part of the first column through a nozzle and wherein the height of the first column from the nozzle to the lower end of the first column is at least twice the depth of liquid in the second column or chamber from the lower end of the first column to the liquid/froth interface.

6. A method as claimed in claim 1 wherein the liquid containing the particulate material is introduced into the first column through a nozzle having an orifice of predetermined diameter and wherein the ratio of the diameter of the first column to the diameter of the orifice is between 5:1 and 12:1.

7. A method as claimed in claim 1 wherein the liquid containing the particulate material is introduced into the upper part of the first column through a nozzle and wherein the ratio of the length of the first column from the nozzle to the lower end of the first column to the diameter of the first column is 8:1 or greater.

8. A method as claimed in claim 1 wherein the second column or chamber is cylindrical in configuration and wherein the ratio of the diameter of the second column to the diameter of the first column is between 2:1 and 10:1.

9. A method as claimed in claim 1 wherein the velocity of the downwardly facing jet at the point that it is introduced into the first column is greater than 8 meters per second.

10. A method of separating particulate material from slurries or suspensions in a liquid, said method comprising the steps of:

introducing the liquid containing the particulate material in a downwardly facing jet into an upper part of a first column having a lower end communicating with a second column or chamber at a point between upper and lower ends of the second column or chamber, the upper part of the first column having a controlled gas inlet;

plunging the jet into a foam bed in the first column causing gas from the first column to be entrained by the jet into the foam bed and generate more foam;

allowing the foam level to rise in the first column until the pressure at the lower end of the first column is greater than the pressure in the second column adjacent the lower end of the first column causing the foam bed to move downwardly in the first column and issue from the lower end into the second column or chamber;

controlling the flow of gas through the controlled gas inlet to maintain the foam level in the first column such that the pressure at the lower end of the first column is greater than the pressure in the second column adjacent the lower end of the first column;

allowing froth from the foam to separate from liquid in the second column forming a liquid/froth interface;

removing the froth with entrained particulate materials from the upper part of the second column; and removing remaining liquid from the lower part of the second column or chamber;

wherein the downwardly facing jet is introduced into the upper part of the first column through an orifice in a nozzle located at the lower end of a pipe positioned substantially concentrically with the first column and wherein the diameter of the pipe is at least twice the diameter of the orifice of the nozzle.

11. A method as claimed in claim 10 wherein the length of the pipe is between two and twenty times the diameter of the pipe.

12. A method as claimed in claim 10 wherein the nozzle is located in the first column below the controlled gas inlet.

13. A method as claimed in claim 1, wherein said foam bed has a void fraction of substantially 0.3–0.6.

14. A method as claimed in claim 10, wherein said foam bed has a void fraction of substantially 0.3–0.6.

* * * * *